US011230900B2

(12) United States Patent
Robertson et al.

(10) Patent No.: US 11,230,900 B2
(45) Date of Patent: Jan. 25, 2022

(54) DOWNHOLE JARRING TOOL WITH ELECTRICAL PASS THROUGH

(71) Applicant: Robertson Intellectual Properties, LLC, Mansfield, TX (US)

(72) Inventors: Michael C. Robertson, Arlington, TX (US); Douglas J. Streibich, Arlington, TX (US); Antony F. Grattan, Arlington, TX (US); Scott L. Hayes, Arlington, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

(21) Appl. No.: 16/993,020

(22) Filed: Aug. 13, 2020

(65) Prior Publication Data

US 2021/0047894 A1 Feb. 18, 2021

Related U.S. Application Data

(60) Provisional application No. 62/886,024, filed on Aug. 13, 2019.

(51) Int. Cl.
*E21B 31/107* (2006.01)
*E21B 4/12* (2006.01)

(52) U.S. Cl.
CPC ..... *E21B 31/107* (2013.01); *E21B 4/12* (2013.01)

(58) Field of Classification Search
CPC ..... E21B 4/12; E21B 31/107
See application file for complete search history.

(56) References Cited

U.S. PATENT DOCUMENTS 517,806 A * 4/1894 Maish ..... E21B 31/107 166/301
1,899,438 A * 2/1933 Grant ..... E21B 4/10 175/95
4,512,424 A * 4/1985 Heemstra ..... E21B 17/07 166/178
4,736,797 A * 4/1988 Restarick, Jr. ..... E21B 17/003 166/178
5,018,590 A * 5/1991 Weldon ..... E21B 4/12 175/105
5,109,921 A * 5/1992 Aracena ..... E21B 17/023 166/377

(Continued)

*Primary Examiner* — Shane Bomar
(74) *Attorney, Agent, or Firm* — Matthews, Lawson, McCutcheon & Joseph, PLLC

(57) ABSTRACT

A jarring tool includes a main body having a central bore extending therein, an upper connection at a proximal end of the main body for attaching the jarring tool to wireline or slickline, a lower portion at a distal end of main body, and a reciprocating hammer fixed at a first position within the central bore of the main body. The jarring tool further includes a central aperture extending along a length of the reciprocating hammer, an electrical connector extending from the upper connection and through the central aperture of the reciprocating hammer to at least the lower portion of the main body, and a release mechanism on the main body for releasing the reciprocating hammer from the first position and allowing reciprocating movement of the reciprocating hammer along the central bore. The electrical connector is configured to break when the reciprocating hammer is released from the first position.

20 Claims, 2 Drawing Sheets

(56) References Cited

U.S. PATENT DOCUMENTS

| | | | | |
|---|---|---|---|---|
| 5,201,814 | A * | 4/1993 | Kitchell | E21B 17/023 166/377 |
| 5,389,003 | A * | 2/1995 | Van Steenwyk | E21B 17/028 439/190 |
| 2015/0176357 | A1* | 6/2015 | Hradecky | E21B 31/107 166/250.01 |
| 2016/0258270 | A1* | 9/2016 | Hradecky | E21B 47/01 |

* cited by examiner

DOWNHOLE JARRING TOOL WITH ELECTRICAL PASS THROUGH

CROSS REFERENCE TO RELATED APPLICATIONS

This application is a non-provisional application that claims priority to U.S. Provisional Application No. 62/886,024, entitled "Downhole Jarring Tool with Electrical Pass Through", filed on Aug. 13, 2019. The disclosure of the prior application is hereby incorporated by reference herein in its entirety.

FIELD

Embodiments usable within the scope of the present disclosure relate, generally, to jarring apparatuses, systems, and methods for applying a mechanical impact to a downhole tool or stuck item in a wellbore. And more particularly, the embodiments relate to apparatuses, systems, and methods for using a jarring tool that serves as an electrical feed-through device before activation of the jarring tool, and as a reciprocating hammer during activation of the jarring tool.

BACKGROUND

Many wellbore operations necessitate deploying a downhole tool within a wellbore. The downhole tool may be a drill, a torch, a cutter, a perforator system, a setting tool, fracturing equipment, or any combination thereof. In some instances, the downhole tool may become stuck at a location inside of a wellbore. In other instances, the downhole tool my encounter an obstruction stuck in the wellbore that blocks the path of the downhole tool through the wellbore. In such cases, it may be necessary to loosen the stuck tool or obstruction with force, such as with mechanical impact, in order to remove the tool or obstruction.

Mechanical impact tools have been used in downhole operations. For instance, a sliding hammer (spang) jarring tool for slicklines may be used. Because that tool has no electrical pass through, the tool has fairly low maintenance. The tool can thus be re-run several times without having to perform maintenance. Other jarring tools may include a pass-through for electrical wireline operations, and may retain the electrical pass-through communication and grounding electrical connection during and after the jarring (impact) sequence. The tools may have several electrical connections for numerous control paths, so that various individual operations can be independently made via isolated electrical connections. However, those jarring tools are complex, and have an associated high cost to build and maintain.

A need exists, in the oil and gas industry, for a jar assembly having an electrical feed through for electrical connection(s), as well as grounding connection for ground connectivity, when the assembly is not being used in a jarring (impact) sequence, so that the assembly only serves as an electrical pass through device and a weight to the tool string before the sequence. And, when the assembly is being used in a jarring (impact) sequence, the electrical connection is broken, as the connection is no longer required. There is thus no complex arrangement of components required to keep the electrical feed through for electrical connection(s) active during the jarring (impact) sequence. This configuration provides a simple, low maintenance design for the assembly.

The present embodiments meet these needs.

SUMMARY

The disclosed embodiments include a jarring tool configured to be inserted into a wellbore. The jarring tool comprises a main body including a central bore extending therein; an upper connection at a proximal end of the main body for attaching the jarring tool to a wireline or slickline tool string; a lower portion at a distal end of the main body; a reciprocating hammer fixed at a first position within the central bore of the main body and including a central aperture extending along a length of the reciprocating hammer; an electrical connector extending from the upper connection and through the central aperture of the reciprocating hammer to at least the lower portion of the main body; and a release mechanism on the main body for releasing the reciprocating hammer from the first position and allowing reciprocating movement of the reciprocating hammer along the central bore of the main body; wherein the electrical connector is configured to break when the reciprocating hammer is released from the first position.

The disclosed embodiments further include a system for impacting a downhole tool or a stuck component in a wellbore. The system comprises a wireline or slickline tool string configured to be inserted into the wellbore, and a jarring tool attached to a portion of the wireline or slickline tool string. The jarring tool comprises a main body, which can include a central bore extending therein, an upper connection at a proximal end of the main body for attaching the jarring tool to the wireline or slickline tool string, and a lower portion at a distal end of the main body. A reciprocating hammer can be fixed at a first position within the central bore of the main body, and can include a central aperture extending along a length of the reciprocating hammer. An electrical connector can extend from the upper connection and through the central aperture of the reciprocating hammer to at least the lower portion of the main body, and a release mechanism, on the main body, can be used for releasing the reciprocating hammer from the first position and allowing reciprocating movement of the reciprocating hammer along the central bore of the main body. The jarring tool can further include a controller for reciprocatingly moving the reciprocating hammer along the central bore of the main body, wherein the electrical connector is configured to break when the reciprocating hammer is released from the first position, and the reciprocating hammer can be configured to impact the downhole tool or the stuck component in the wellbore via the reciprocating movement.

The disclosed embodiments can include a method for impacting a downhole tool or a stuck component in a wellbore. The method steps comprise attaching a jarring tool to a portion of a wireline or slickline tool string. The jarring tool comprises a main body, which can include a central bore extending therein, an upper connection at a proximal end of the main body for attaching the jarring tool to the portion of the wireline or slickline tool string, and a lower portion at a distal end of the main body. The jarring tool can include a reciprocating hammer, which can be fixed at a first position within the central bore of the main body and can include a central aperture extending along a length of the reciprocating hammer. The jarring tool can further include an electrical connector extending from the upper connection and through the central aperture of the reciprocating hammer to at least the lower portion of the main body, and the jarring tool can include a release mechanism on the main body for releasing the reciprocating hammer from the first position and allowing reciprocating movement of the reciprocating hammer along the central bore of the main body.

The steps of the method can continue by applying an over-pull tension to the jarring tool to release the release mechanism, move the reciprocating hammer from the first position, and break the electrical connector. Then, the steps of the method can conclude by reciprocatingly moving the reciprocating hammer along the central bore of the main body to impact the downhole tool or the stuck component in the wellbore.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed FIGS.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "uphole", "downhole", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
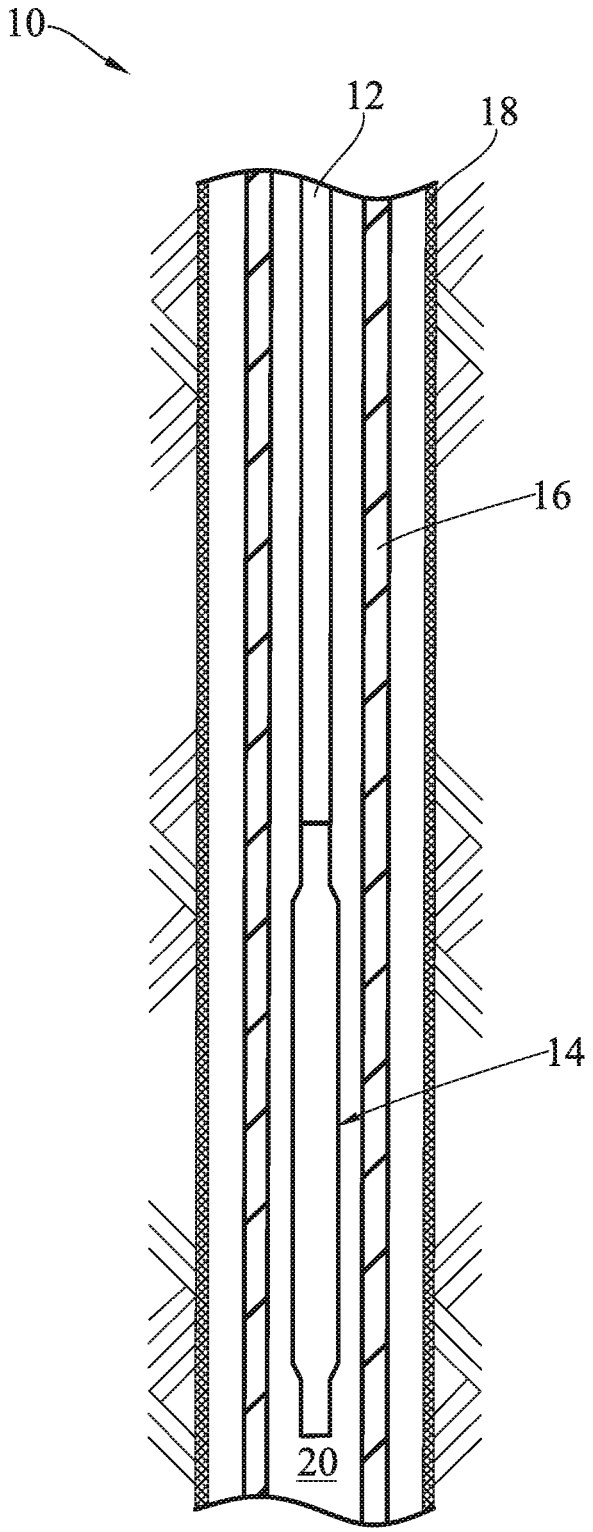
FIG. 1 illustrates a cross-sectional schematic view of an embodiment of a system located in a possible operating environment.

FIG. 1 illustrates a cross-sectional schematic view of an embodiment of a system 10 for impacting a downhole tool or a stuck component in a wellbore. The illustrated system 10 is located in a possible operating environment. The system 10 may include a wireline or slickline tool string 12 and a jarring tool 14 that have been lowered into production tubing 16 and/or casing 18 within a wellbore 20. The casing 18 may be cemented or otherwise set within the wellbore 20 to protect the surrounding rock structure and prevent collapse. The wellbore 20 may be located in or through a production zone from which hydrocarbons or other fluid may be pumped out through the production tubing 16.

Figure 2:
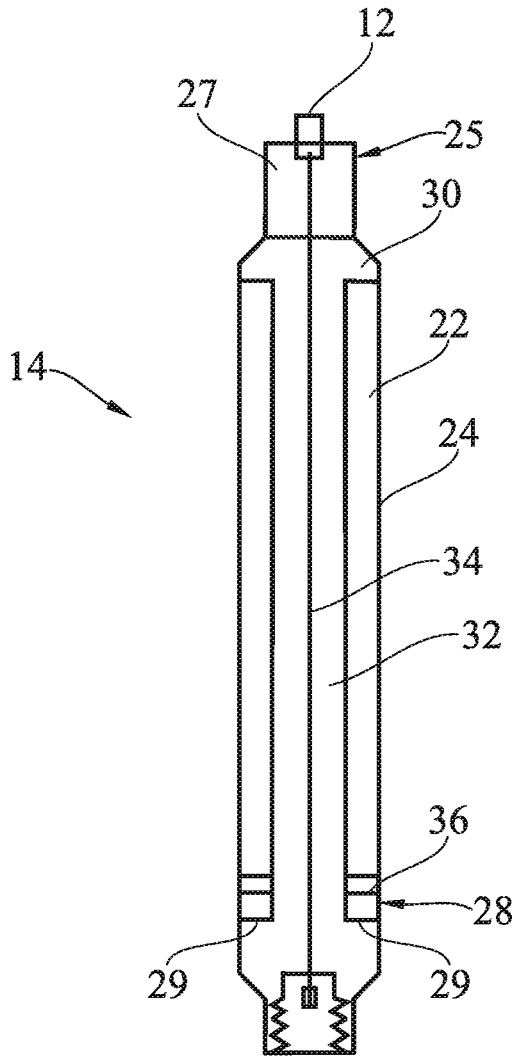
FIG. 2 illustrates a cross-sectional view of an embodiment of a jarring tool in a closed, running position.

FIG. 2 shows an embodiment of the jarring tool 14. The jarring tool 14 may be attached to a portion of the wireline or slickline tool string 12, and includes a main body 24 having a central bore 22 extending therein. The main body 24 includes a proximal end 25 and a distal end 28. The proximal end 25 of the main body 24 can include an upper connection 27 that can be used for attaching the jarring tool 14 to the wireline or slickline tool string 12. A reciprocating hammer 30 can be fixed at a first position within the central bore 22 of the main body 24. The reciprocating hammer 30 can include a central aperture 32 extending along a length of the reciprocating hammer 30.

As shown, an electrical connector 34 extends from the upper connection 27 and through the central aperture 32 of the reciprocating hammer 30 to at least the distal end 28 of the main body 24. While only one electrical connector 34 is shown in the illustrated embodiment, one or more electrical connectors 34 may be present. Note that the electrical connector(s) 34 may be exposed to the wellbore environment without insult to the connection competency of the electrical connector(s) 34. The electrical connectors 34 may include connectors and wires that are chemical resistant, vibration resistant, and rated for high temperatures and pressures that may exist in oilfield wellbores. In one embodiment, the main body 24 itself of the jarring tool 14 may be used for electrical grounding competency. In another embodiment, a separate grounding connection (not shown) may be used in combination with the electrical connector(s) 34. A release mechanism 36 can be provided on the main body 24, and can be configured to release the reciprocating hammer 30 from the first position and allow reciprocating movement of the reciprocating hammer 30 along the central bore 22 of the main body 24. The reciprocating movement of the reciprocating hammer 30 may be controlled by a controller (not shown) at, for example, the surface of the well.

The jarring tool 14 may be used to assist in the release of a downhole tool or other item that stuck downhole in a wellbore 20. The downhole tool or other item may be stuck for a number of reasons. After confirming that the downhole tool or other item is stuck in the wellbore 20, the jarring tool 14 may be used to apply a mechanical impact to the stuck tool or item. As discussed above, the jarring tool 14 can have an electrical feed through connection (e.g., a conduit or area for accommodating the electrical connector 34, which may comprise electrical wires) when the jarring tool 14 is in a "closed" position, i.e., when the jarring tool 14 is not being used in a jarring (impact) sequence, so that the jarring tool 14 serves only as an electrical pass through device and a weight to the wireline or slickline tool string 12. The jarring tool 14 may be deployed downhole in the "closed" position prior to any jarring action or requirement.

Figure 3:
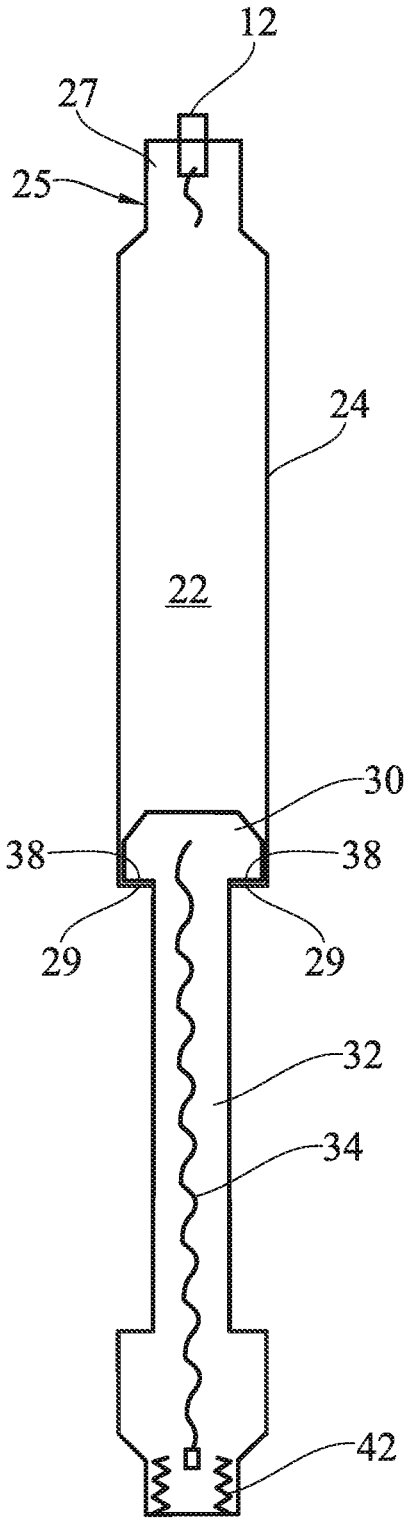
FIG. 3 illustrates a cross-sectional view of an embodiment of a jarring tool in an open, jarring position.

When the jarring (impact) sequence is required, an over-pull tension can be applied to the jarring tool 14 to initiate the jarring feature. The jarring feature can be enabled by activating the release mechanism 36 that allows the jarring tool 14 to be telescoped between an extended (open) position, as shown in FIG. 3, and retracted (closed) position, as shown in FIG. 2. Under a predetermined tension applied, the sliding action and end stop features of a reciprocating hammer 30, against a shoulder 29 at the distal end 28 of the main body 24, translate to a transferrable impact. In an embodiment, the main body 24 may include apertures (not shown) serving as passages that allow free exchange of fluid and/or semi-fluid in the wellbore 20 during the telescoping motion of the reciprocating hammer 30. Having the wellbore fluid and/or semi-fluid pass through the apertures inhibits the wellbore fluid (and/or semi-fluid) from dampening the stroke velocity of the reciprocating hammer 30. With the jarring tool 14 being used as an inertial impact tool in this situation, the electrical connector 34, present in the electrical feed through of the jarring tool 14, is no longer required, and can be broken by the jarring action. That is, the electrical feed through, or electrical connector 34, of the jarring tool 14 is a single or limited use electrical pass through component. There is thus no complex arrangement of components required to keep the electrical feed through connection active during the jarring (impact) sequence. This configuration provides a simple, low maintenance design for the assembly.

As shown, the electrical connector 34 can be configured to break when the reciprocating hammer 30 is released from the first position. Once released, the reciprocating hammer 30 is configured to impact a downhole tool or a stuck component in the wellbore 20 via the reciprocating axial movement. The electrical connector 34 can be configured so that a portion of the electrical connector 34 remains within the central aperture 32 of the reciprocating hammer 30 after the electrical connector 34 is broken. In an embodiment, the reciprocating hammer 30 may be connected to a pre-loaded spring or torsion bar (not shown) so that the reciprocating movement includes an inertial rotation as part of the jarring effect. For instance, the reciprocating hammer 30 may rotate once per foot up-hole or down-hole. Such a combined twist (from the pre-loaded spring or torsion bar) and pull (from the axial impact) effect by the reciprocating hammer 30 will add rotational failure to go along with the pull shear to the downhole tool or a stuck component. The additional rotational twisting force may make it easier to free the downhole tool or a stuck component.

The controller applies an over-pull tension to the jarring tool 14 to release the release mechanism 36 and move the reciprocating hammer 30. In one embodiment, the release mechanism 36 can be at least one shearing pin that holds the reciprocating hammer 30 in the first position. The shearing pin can be configured to be sheared by the over-pull tension to release the reciprocating hammer 30 from the first position. The jarring tool 14 may be designed with a pre-calculated impact force necessary to shear the shearing pin or other pre-set release mechanism 36 while limiting application of excessive tensile force resulting in fatigue or otherwise catastrophic failure of the mechanisms or tools below the jarring tool 14. The pre-calculated impact force may be selected based on conditions in the wellbore 20 and at the wellbore site, the type of release mechanism 36, and on the nature of the downhole tool or the stuck component in the wellbore 20. In another embodiment of the releasing or shearing process, the release mechanism 36 may be configured to activate at a relatively lower tension value whereby the release mechanism 36 (e.g., a plurality of shearing pins) is sheared through the application of cyclic or sequential over-pulls such that a lower tension over-pull application applied over multiple cycles or sequences would result in the shear to activate the release mechanism 36. For instance, a number (e.g., 10 to 15) of cyclic over-pulls at 500 lbs may be used to activate release mechanism 36 in this embodiment, compared to, for example, a single over-pull at 1000 lbs to activate release mechanism 36. This embodiment may be useful when the over-pull tension that can be applied is limited by circumstances at the wellbore site.

In a further embodiment, the releasing or shearing process may involve utilizing a bi-metallic or bi-material shear mechanism as the release mechanism 36, which allows the primary material to erode or degrade over time. The erosion or degradation reduces the shear strength capacity of the release mechanism 36 in a calculated manner after an exposed time in contact with the wellbore fluid. Such materials may include magnesium, aluminum, one or more polymers, or other material(s) with a known rate of decay. This would result in a lower shear force required to release activation tension over-pull at the time of jarring. The "exposure sensitive" material may additionally be coated with a mechanical force (typically tension) frangible layer (such as a ceramic) that, upon application of tension, would fracture and expose the previously mentioned wellbore fluid eroding layer. The series of strength states of this bi-metallic or bi-material shear mechanism would allow for full strength elements with a surface force application determination as to when the lower shear force limit would be encountered/achieved.

The shoulder 29 at the distal end 28 of the main body 24 can prevent the reciprocating hammer 30 from completely exiting the central bore 22 of the main body 24 during the reciprocating movement. In an embodiment, the shoulder 29 can be a no-go shoulder, and the reciprocating hammer 30 can include a corresponding shoulder 38 that can contact the no-go shoulder 29 to prevent the reciprocating hammer 30 from completely exiting the central bore 22 of the main body 24.

The end of the reciprocating hammer 30 may include a lower connection 42 for connecting the jarring tool 14 to another portion of the wireline or slickline tool string 12 or to a downhole tool (not shown).

The jarring tool 14 thus has a functioning electrical connector 34 (electrical feed through connection) when the assembly is not being used in a jarring sequence (see FIG. 2), so that the jarring tool 14 serves only as an electrical pass through device and a weight to the tool string before the jarring sequence. When the jarring tool 14 is used in the jarring sequence, the electrical connector 34 (electrical feed through connection) is broken (see FIG. 3), as the electrical connection is no longer required. There is thus no complex arrangement of components required to keep the electrical connector 34 (electrical feed through connection) active during the jarring sequence. The jarring tool 14 therefore has a simple, low maintenance design.

By serving as two components in one (i.e., an electrical pass through device/weight and a mechanical impact tool), the jarring tool 14 is a versatile, compact, low-cost alternative to conventional systems that attempt to maintain an electrical connection during a jarring sequence. Further, the jarring sequence may be activated only if required. Because the electrical feed through of the jarring tool 14 is designed to be broken, the jarring tool 14 does not have the complexity of the conventional systems. Moreover, the conventional systems attempting to integrate a non-breakable electrical pass through with a mechanical impact tool into a tool string may not even be possible for limited height well operations. The combination of the electrical pass through device/weight bar and a mechanical impact tool is also more compact than using those two traditional systems, separately.

While various embodiments usable within the scope of the present disclosure have been described with emphasis, it should be understood that within the scope of the appended claims, the present invention can be practiced other than as specifically described herein.

What is claimed is:

1. A jarring tool configured to be inserted into a wellbore, comprising:

a main body including a central bore extending therein;

an upper connection at a proximal end of the main body for attaching the jarring tool to a wireline tool string or a slickline tool string;

a lower portion at a distal end of the main body;

a reciprocating hammer fixed at a first position within the central bore of the main body and including a central aperture extending along a length of the reciprocating hammer;

an electrical connector extending from the upper connection and through the central aperture of the reciprocating hammer to at least the lower portion of the main body; and a release mechanism on the main body for releasing the reciprocating hammer from the first position and allowing reciprocating movement of the reciprocating hammer along the central bore of the main body, wherein the electrical connector is configured to break when the reciprocating hammer is released from the first position.

2. The jarring tool of claim 1, further comprising a controller for reciprocatingly moving the reciprocating hammer along the central bore of the main body.

3. The jarring tool of claim 1, wherein the reciprocating hammer is configured to impact a downhole tool or a stuck component in the wellbore via the reciprocating movement.

4. The jarring tool of claim 1, wherein the release mechanism is at least one shearing pin that holds the reciprocating hammer in the first position, wherein the shearing pin is configured to be sheared to release the reciprocating hammer from the first position.

5. The jarring tool of claim 1, wherein the release mechanism is a bi-metallic or bi-material shear mechanism that allows a primary material of the shear mechanism to erode or degrade over time to reduce a shear strength capacity of the shear mechanism after an exposed time in contact with fluid in the wellbore.

6. The jarring tool of claim 1, further comprising a stop at the lower portion for preventing the reciprocating hammer from completely exiting the central bore of the main body during the reciprocating movement.

7. The jarring tool of claim 6, wherein the stop is a no-go shoulder, and wherein the reciprocating hammer includes a corresponding shoulder that contacts the no-go shoulder to prevent the reciprocating hammer from completely exiting the central bore of the main body.

8. The jarring tool of claim 1, wherein an end of the reciprocating hammer includes a lower connection for connecting the jarring tool to another portion of the wireline or slickline tool string or to a downhole tool.

9. The jarring tool of claim 1, wherein the electrical connector is configured so that a portion of the electrical connector remains within the central aperture of the reciprocating hammer after the electrical connector is broken.

10. The jarring tool of claim 1, wherein the main body includes at least one aperture that allows entry of wellbore fluid and/or semi-fluid to inhibit dampening of the reciprocating movement of the reciprocating hammer in the wellbore.

11. A system for impacting a downhole tool or a stuck component in a wellbore, comprising:

a wireline tool string or a slickline tool string configured to be inserted into the wellbore;

a jarring tool attached to a portion of the wireline tool string or the slickline tool string, wherein the jarring tool comprises:

a main body including a central bore extending therein;

an upper connection at a proximal end of the main body for attaching the jarring tool to the wireline tool string or the slickline tool string;

a lower portion at a distal end of the main body;

a reciprocating hammer fixed at a first position within the central bore of the main body and including a central aperture extending along a length of the reciprocating hammer;

an electrical connector extending from the upper connection and through the central aperture of the reciprocating hammer to at least the lower portion of the main body;

a release mechanism on the main body for releasing the reciprocating hammer from the first position and allowing reciprocating movement of the reciprocating hammer along the central bore of the main body; and a controller for reciprocatingly moving the reciprocating hammer along the central bore of the main body, wherein the electrical connector is configured to break when the reciprocating hammer is released from the first position, and wherein the reciprocating hammer is configured to impact the downhole tool or the stuck component in the wellbore via the reciprocating movement.

12. The system of claim 11, wherein the controller applies an over-pull tension to the jarring tool to release the release mechanism and move the reciprocating hammer.

13. The system of claim 12, wherein the release mechanism is at least one shearing pin that holds the reciprocating hammer in the first position, and that is configured to be sheared by the over-pull tension to release the reciprocating hammer from the first position.

14. The system of claim 11, wherein the jarring tool further comprises a stop at the lower portion for preventing the reciprocating hammer from completely exiting the central bore of the main body during the reciprocating movement.

15. The system of claim 11, wherein an end of the reciprocating hammer includes a lower connection for connecting the jarring tool to another portion of the wireline tool string or the slickline tool string or to a downhole tool.

16. The system of claim 11, wherein the electrical connector is configured so that a portion of the electrical connector remains within the central aperture of the reciprocating hammer after the electrical connector is broken.

17. The system of claim 11, wherein the main body includes at least one aperture that allows entry of wellbore fluid and/or semi-fluid to inhibit dampening of the reciprocating movement of the reciprocating hammer in the wellbore.

18. A method for impacting a downhole tool or a stuck component in a wellbore, the method comprising:

attaching a jarring tool to a portion of a wireline tool string or a slickline tool string, the jarring tool comprising:

a main body including a central bore extending therein;

an upper connection at a proximal end of the main body for attaching the jarring tool to the portion of the wireline tool string or the slickline tool string; a lower portion at a distal end of the main body;

a reciprocating hammer fixed at a first position within the central bore of the main body and including a central aperture extending along a length of the reciprocating hammer;

an electrical connector extending from the upper connection and through the central aperture of the reciprocating hammer to at least the lower portion of the main body; and a release mechanism on the main body for releasing the reciprocating hammer from the first position and allowing reciprocating movement of the reciprocating hammer along the central bore of the main body;

applying an over-pull tension to the jarring tool to release the release mechanism, move the reciprocating hammer from the first position, and break the electrical connector; and reciprocatingly moving the reciprocating hammer along the central bore of the main body to impact the downhole tool or the stuck component in the wellbore.

19. The method of claim 18, wherein a portion of the electrical connector remains within the central aperture of the reciprocating hammer after the electrical connector is broken.

20. The method of claim 18, further comprising allowing entry of wellbore fluid and/or semi-fluid into the main body via at least one aperture in the main body to inhibit dampening of the reciprocating hammer while reciprocatingly moving the reciprocating hammer in the wellbore.

* * * * *